US006926576B1

(12) United States Patent
Alway et al.

(10) Patent No.: US 6,926,576 B1
(45) Date of Patent: Aug. 9, 2005

(54) ROCKET WITH BACKWARDS GLIDING RECOVERY

(76) Inventors: Peter Curtis Alway, 2830 Pittsfield, Ann Arbor, MI (US) 48104; Robert Matthew Alway, 1012 Barton, Otsego, MI (US) 49078

( * ) Notice: Subject to any disclaimer, the term of this patent is extended or adjusted under 35 U.S.C. 154(b) by 334 days.

(21) Appl. No.: 09/682,167

(22) Filed: Jul. 30, 2001

(51) Int. Cl.[7] ..... A63H 27/00
(52) U.S. Cl. ..... 446/34; 446/52; 446/56
(58) Field of Search ..... 446/34, 52, 56, 446/62, 88, 211, 76

(56) References Cited

U.S. PATENT DOCUMENTS

| | | | | |
|---|---|---|---|---|
| 2,841,084 A | | 7/1958 | Carlisk | |
| 3,114,317 A | | 12/1963 | Estes | |
| 3,157,960 A | | 11/1964 | Schutz et al. | |
| 3,452,471 A | | 7/1969 | Street | |
| 3,965,611 A | * | 6/1976 | Pippin, Jr. | |
| 5,707,270 A | * | 1/1998 | Johnson et al. | 446/400 |

FOREIGN PATENT DOCUMENTS

JP 08136198 A * 5/1996

OTHER PUBLICATIONS

AVI Astroport advertising flyer and instruction sheet Mineral Point, WI 53565.

Robert H. Goddard, Esther C. Goddard, G. Edward Pendray Rocket Development Liquid–Fuel Rocket Research 1929–1941. ©1948 pp 112–115 Prentice–Hall, Inc. United States.

Jim Barroman Technical Information Report 33 Calculating the Center of Pressure ©1970 pp 1–38 Centuri Engineering Company Phoenix, Arizona 85001.

Vernow Estes Technical Report TR–1 Rocket Stability 1960–1965 pp 1–2 Estes Industries, Penrose CO.

William J. Taylor, III Technical Report TR–9 Designing Stable Rockets ©1965 pp 1–4 Estes Industries, Penrose, CO.

* cited by examiner

*Primary Examiner*—Derris H. Banks
*Assistant Examiner*—Ali Abdelwahed
(74) *Attorney, Agent, or Firm*—Robert Matthew Alway

(57) ABSTRACT

This invention is a long thin rocket that launches forward and glides backward after an ejection pitch maneuver with no moving parts. It takes advantage of a shift in center of pressure caused by a change in the angle of incidence of the rocket. This change in angle of incidence is caused by the side thrust pitch maneuver. The pitch maneuver is initiated by the ejection charge out a side thrust port or other side thrusting apparatus at a location on the rocket causing a large torque about the center of gravity of the rocket. The center of gravity of the rocket after the pitch is optimally less than 60% of the way between the Barrowman center of pressure and the center of lateral area center of pressure.

14 Claims, 3 Drawing Sheets

ROCKET WITH BACKWARDS GLIDING RECOVERY

BACKGROUND OF INVENTION

Rockets, particularly model rockets, have been recovered from flight using a variety of methods. Examples include crash recovery, nose blow recovery, parachute recovery, streamer recovery, retrorocket recovery, tumble recovery, and glide recovery. Virtually all previous modes of recovery, except crash recovery, require moving parts. Crash recovery, while having been used in practice, is obviously the least satisfactory method because of damage to the rocket and hazard to persons and objects on the ground. Nose blow recovery, when used in full sized rockets, offers substantial improvement in the salvageability of rocket and payload components. Used in model rocketry, nose blow recovery has been called float recovery. In nose blow recovery the ejection of the nose cone destabilizes the rocket such that the main section of the rocket floats or glides. Parachute recovery is a notorious method used routinely to recover rockets safely. Streamer recovery is based on the aerodynamic drag created by a long narrow sheet attached to the rocket with an appropriate line. Retrorocket recovery is based upon the firing of rockets to slow descent of the rocket before impact. Tumble recovery relies on shifting the center of gravity of a rocket causing the rocket to be unstable. The unstable rocket tumbles, creating substantial drag, which slows the descent of the rocket.

Glide recovery may be used to recover part or all of a rocket. When part of the rocket is recovered as a glider, it is termed a boost glider. When the entire rocket, including the engine, is recovered as a glider, it is termed a rocket glider. Previous means of glide recovery have used separation of parts, movement of aerodynamic surfaces, or a shift in center of gravity to transition from a near vertical rocket launch to glide recovery. The instant invention is primarily, but not exclusively, useful as a rocket glider. This invention uses a side thrust port or sideways thrusting means, on a rocket with fixed aerodynamic geometry and fixed center of gravity, to change the stability from narrow angle forward stability to a gliding rearward stability. The center of gravity may incidentally move forward during flight due to the consumption of fuel in a rearward mounted engine.

U.S. Pat. No. 3,114,317, Estes, when reduced to practice, uses a side thrust port but not a fixed center of gravity or glide recovery as in the current invention. Estes teaches a rearward shift in center of gravity for tumble recovery. U.S. Pat. No. 3,157,960, Schutz et al uses glide recovery but lacks the fixed aerodynamic geometry and the fixed engine of the current invention. Goddard, Goddard and Pendray, ROCKET DEVELOPMENT LIQUID-FUEL ROCKET RESEARCH 1929–1941 discloses sideways recovery of a rocket with a gyroscopically controlled moveable tail casing. Schutz et al, along with Goddard, Goddard and Pendray, teach a shift in aerodynamic surfaces including fin flaps and moveable fins, for rocket glide recovery. U.S. Pat. No. 3,452,471, Street, pop pod glider uses glide recovery but lacks the fixed center of gravity of the current invention. Street teaches a rearward shift in the center of gravity due to the loss of the engine assembly for glide recovery. Certain similar designs rely only on the loss of engine propellant in a forward mounted engine to shift the center of gravity rearward. The AVI ASTROPORT advertising flyer LINAEUS GIGANTUS uses a tall rocket with a large length to diameter ratio and ejectable nose cone for a rearward gliding recovery but lacks the side thrust port of the current invention AVI ASTROPORT teaches a shift in a shift in aerodynamic surfaces or nose ejection and an effective rearward shift in center of gravity for glide or float recovery. Taken individually or in combination, these examples of prior art teach that the center of gravity or center of pressure of a rocket must be changed by physical means to allow for glide recovery of a rocket. In particular the center of gravity must be moved rearward, often using moving parts, or the center of pressure forward by the use of moving parts for a successful transition from rocket to glider.

U.S. Pat. No. 2,841,084, Carlisle, is the basic patent for model rockets specifying a model rocket engine. Specifically a model rocket engine contains a propellant train, a delay train and an ejection charge. The delay train allows the rocket to coast to an appropriate altitude after being boosted by the propellant. The ejection charge is used for deploying the recovery device. It is the ejection charge that provides the sideways thrusting means when directed through the side thrust port of the current invention. Engine ejection is when the ejection charge of the rocket engine explodes. Model rockets are defined as weighing less than 1 pound (454 grams) and having less than 4 ounces (113 grams) of propellant. Large model rockets are defined as exceeding either of those limits yet weighing less than 1500 grams and having less than 125 grams of propellant.

Barrowman, Technical Information Report 33 CALCULATING THE CENTER OF PRESSURE OF A MODEL ROCKET, discloses the detailed method of determining the Barrowman Center of Pressure. Estes, Technical Report TR-1 Rocket Stability, discloses a method of Lateral Area Calculations for determining center of pressure. Taylor, Technical Report TR-9 Designing Stable Rockets, discloses the detailed method of Center Lateral Area calculations for determining center of pressure. These publications were produced by Centuri Engineering and Estes Industries, respectively. These companies have merged since publication.

SUMMARY OF INVENTION

A rocket having a body with a large length to diameter ratio, fixed aerodynamic surfaces, fixed or forward moving center of gravity, and a side thrusting means fixed on the rocket at a distance from the center of gravity sufficient to provide torque to rotate the stable flying rocket substantially perpendicular to the direction of flight, is launched vertically. At, or near apogee, the side thrusting means is activated. This activation may be made by the ejection charge of a rocket engine, particularly a model rocket engine. The side thrust may be generated by the ejection charge being vented through a hole or port in the body tube near the nose cone. After the side thrust is complete, the rocket stabilizes in a horizontal backwards glide. Hence the name given to these rockets of Backslider.

DETAILED DESCRIPTION

Figure 1:
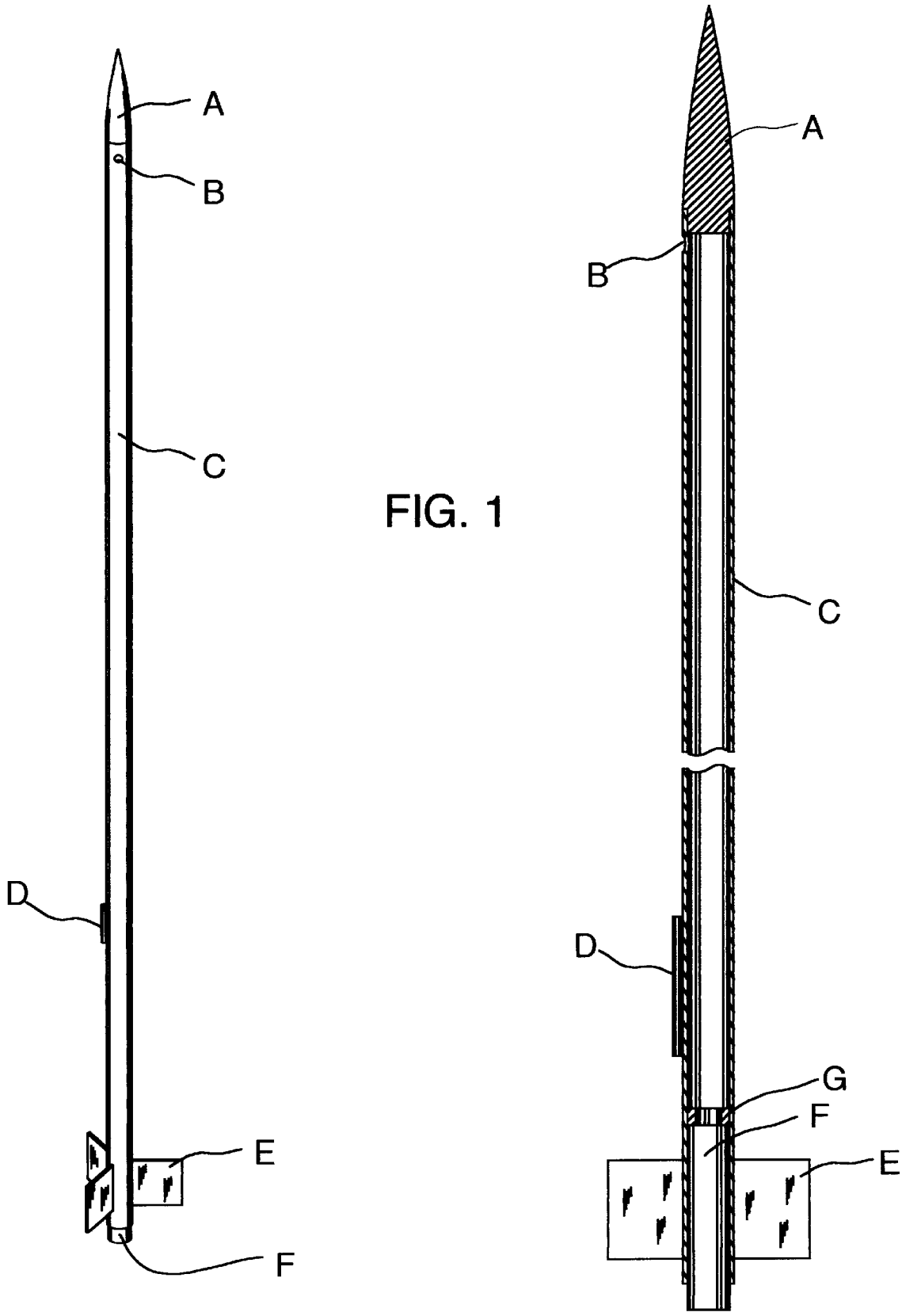
FIG. 1 illustrates the Backslider rocket with both an external full-length view and a shortened cross section view. The components of the rocket are labeled as follows; A fixed nose cone, B Ejection port side thrusting means, C high length to diameter ratio body tube, D launch lug, E fins, F fixed rearward mounted Engine. and G Engine Block.

The rocket of this invention launches and coasts in a stable forward manner. A side thrust means, which may be an ejection charge vented through a port, destabilizes the rocket. The rocket then orients horizontally and glides backwards for recovery. This invention relies on the change in stabilization effects of various parts of a rocket depending on the angle of incidence of the rocket to the oncoming air stream. We have found that the greatest change in the center of pressure with varying angle of incidence occurs with long thin rockets, that is, rockets with a high length to diameter ratio. A high angle of incidence is defined as the air stream impinging nearly perpendicular to the long axis of the rocket. A low angle of incidence is defined as the air stream impinging nearly parallel to the long axis of the rocket. Specifically, at a high angle of incidence the body tube, excluding fins and nose cone, of the rocket has an important effect on the center of pressure of the rocket. At low angle of incidence, the effect of the body tube, excluding fins and nose cone, of the rocket has an insignificant effect on the center of pressure and only the nose cone and fins are important in determining the center of pressure of the rocket. Because rockets are usually launched at a low angle of incidence, calculations for center of pressure using only fin and nosecone effects are normally made. The most common method of center of pressure calculation using only fin and nose cone effects is known as Barrowman Calculations. The method of using the cross section of the rocket, including the body tube, to determine center of pressure is center of lateral area (CLA). CLA calculations are simpler than Barrowman Calculations. CLA is also referred to as the cardboard cutout method because the center of pressure is assumed to be the geometric center of a vertical cross section of the rocket, and a cardboard model of that cross section balances on that center of pressure. Both methods of calculating center of pressure are long notorious in the art.

A rocket having a body with a large length to diameter ratio, fixed aerodynamic surfaces, and a side thrusting means fixed on the rocket at a distance from the center of gravity sufficient to provide torque to rotate the stable flying rocket substantially perpendicular to the direction of flight, is launched vertically. At, or near apogee, the side thrusting means is activated. This activation may be made by the ejection charge of a rocket engine, particularly a model rocket engine. The side thrust may be generated by the ejection charge being vented through a hole or port in the body tube near the nose cone. After the side thrust is complete, the rocket stabilizes in a horizontal backwards glide. Hence the name given to these rockets of Backslider.

For reliable transition to backwards glide, the rocket, model rocket, or large model rocket has four main elements:

1. Fixed aerodynamic surfaces,

2. Large length to diameter ratio, preferably the length to diameter ratio is at least 30 to 1, more preferably the length to diameter ratio is at least 50 to 1.

3. Fixed rearward mounted engine wherein the center of gravity is fixed or moves forward due the effects of fuel consumption, the center of gravity is between the Barrowman center of pressure and the center of lateral area after the pitch maneuver, which is at engine ejection for model rockets. Preferably the center of gravity is less than 60% of the distance from the Barrowman center of pressure to the center of lateral area after the pitch maneuver.

4. A side thrusting means fixed on the rocket at a distance from the center of gravity sufficient to pitch the stable flying rocket in a manner to disrupt the aerodynamic stability of the rocket. Preferably the pitch maneuver turns the rocket substantially perpendicular to the direction of flight. Preferably the pitch maneuver is activated after engine shutdown or burnout, wherein the side thrusting means is an ejection port. The ejection port maybe located in the body tube just below the nose cone. The ejection charge from the model rocket engine may be vented through the ejection port.

For model rockets the description may be simplified to: A model rocket comprising a body tube with a length to diameter ratio of at least 30 to 1, fixed aerodynamic surfaces, a fixed center of gravity after engine ejection less than 60% the distance from the Barrowman center of pressure to center of lateral area after the pitch maneuver, a fixed rearward mounted engine, and an ejection charge vent hole just below the nose cone.

On an ordinary rocket with fins, body tube, and nose cone, the Barrowman center of pressure (BCP) is normally to the rear of the CLA. On ordinary rockets with a short body tube the distance, as a fraction of overall rocket length, between BCP and CLA is small. An ordinary rocket has a length to diameter ratio less than 25 to 1. The length to diameter ratio is based on the total length of the rocket including body tube, nose cone, and engine compared to the diameter of the body tube excluding fins. As the length of the rocket increases, the distance between BCP and CLA increases not only in absolute terms but also increases as a fraction of total rocket length. On rockets of sufficient length the change of center of gravity due to fuel consumption is insufficient to make a rocket too stable to transition to a glide even if the rocket was Barrowman stable at launch. A length to diameter ratio of 30 to 1 or larger is enough to build a working glide recovery system. The forward shift of center of gravity due to fuel consumption in a rearward mounted engine makes rocket gliders with a length to diameter ratio less than 30 to 1 impractical. Test models with a length to diameter ratio of 50 to 1 or larger have made glide recoveries with high reliability.

The use of square fins in the example is not meant to limit the scope of the invention to square fins of equal size, but rather to simplify the description of the principles of the invention. Barrowman calculations for the center of pressure of rockets, particularly model rockets and large model rockets are notorious in the art.

The Barrowman calculations are known in the art to apply only to low angles of attack, usually less than ten degrees. Simplified calculations for the Barrowman center of pressure for a rocket using square fins:

$$5.0\times(s/d)^2\times(1+0.5d/(s+0.5d))=\text{the normal force on the fins (FNF) of a 3 fin rocket.}$$

The center of pressure on square fin (FCP) is ¼ of way back from the leading edge of the fin.

Where s equals the length of one side of a fin and d equals the diameter of the rocket body. Any unit of length may be used as long as the units are consistent.

2.0=the normal force on a nose (NNF) cone of diameter d.

The center of pressure of an ogive nose cone (NCP) is 0.466 from the tip of the nose cone.

The normal force on the body tube is assumed to be zero. Barrowman Center of pressure is then calculated:

$$BCP = [(FCP \times FNF) + (NCP \times NNF)]/(FNF + NNF)$$

BCP. FCP, and NCP are all measured from the tip of the nose cone.

Figure 2:
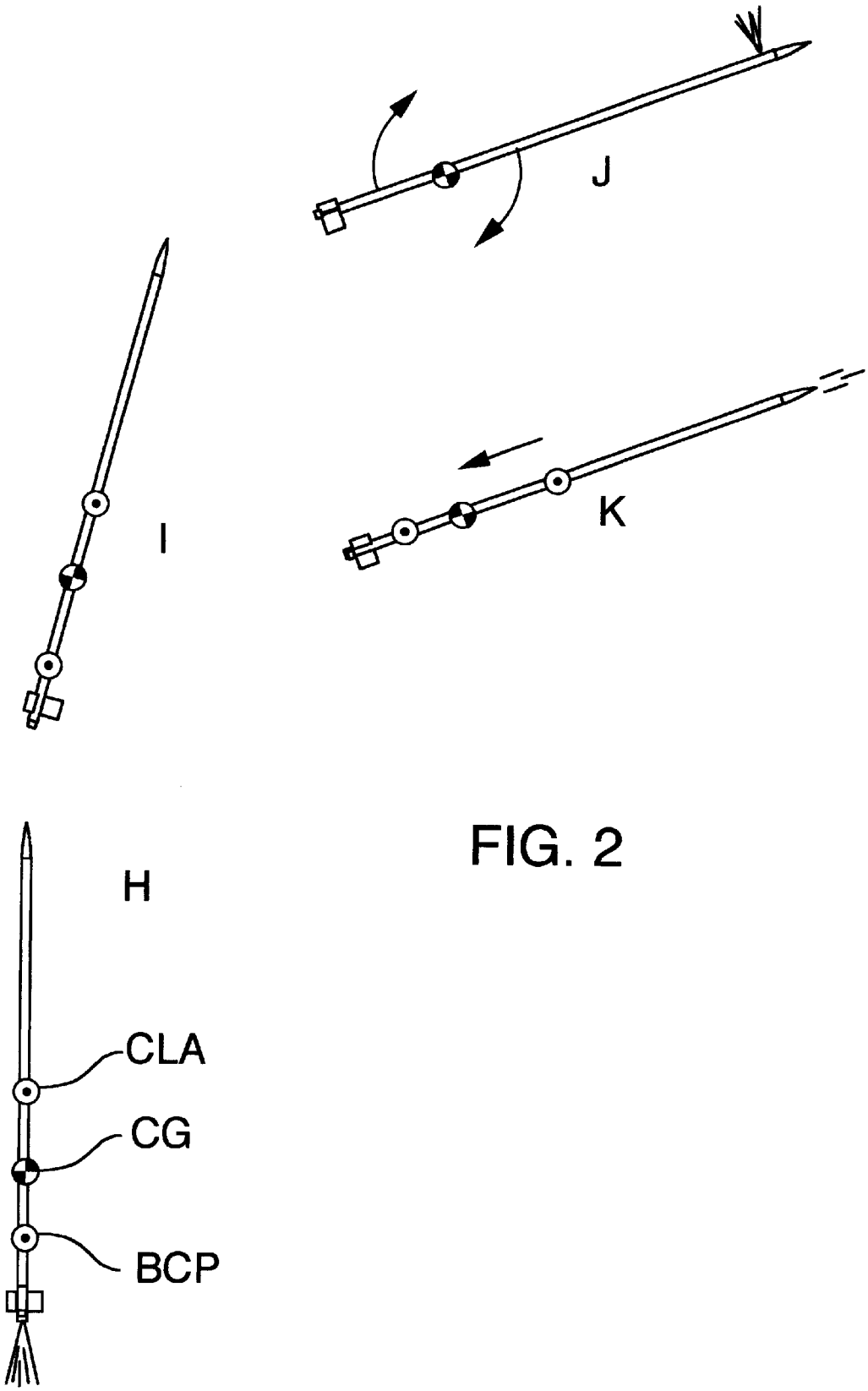
FIG. 2 illustrates the Backslider flight sequence. H is the launch phase with BCP (Barrowman Center of Pressure), CG (Center of Gravity), and CLA labeled (Center of Lateral Area). I is the coast phase of flight with BCP, CG, and CLA marked as in H. J illustrates the pitch maneuver with the side thrust means activated. K illustrates backwards glide recovery with BCP, CG, and CLA marked as in H.
Figure 3:
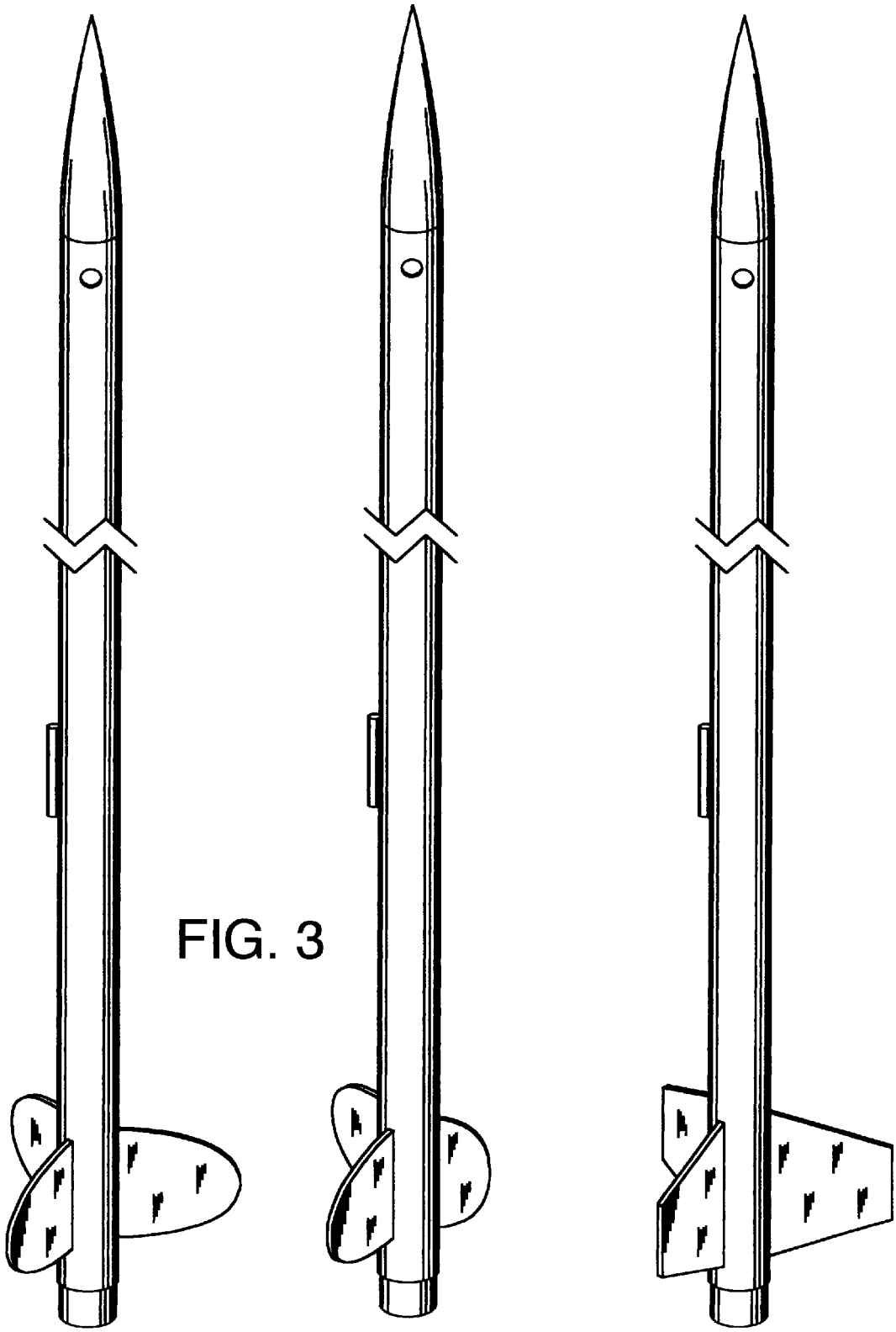
FIG. 3 illustrates various symmetric and asymmetric fin combinations that may be used with a backslider. Not all fins on an individual rocket need to be identical.

The following examples used 0.736-inch diameter by 34-inch long cardboard tube for the main body tube, 0.736-inch diameter by 2.75-inch long cardboard tube for the engine/fin mount extension to the body tube fitted with model rocket engine, and a 0.736-inch diameter by 2.25 inch long balsa ogive nose cone. The engine was a standard 18 mm diameter by 2.75-inch long engine. Square fins of varying sizes were mounted on the engine/fin mount as shown in FIG. 2. The length to diameter ratio was approximately 53 to 1. Each example used three square fins mounted on the engine/fin mount.

Models with 2.5-inch fins and models with 2.0-inch fins flew stably and nose-dived on ejection unless spinning. Spinning models glided backwards until the spinning stopped.

Models with 2.0-inch fins with tail weight added flew stably and glided backwards on ejection. Weights were gradually removed from the tail until the model nosed dived on ejection. Backwards glide was achieved as long as the center of gravity at ejection was less than 60% of the way from the BCP to the CLA.

Models with 1.5-inch fins and models with 1.0-inch fins flew stably and glided backwards on ejection. Models with 1.5-inch fins were the best mode tested for square fins. Depending upon the needs for a specific design, the best mode may be different.

Models with 0.75 inch were unstable at launch.

A model with 2.0-inch chord by 2.0 inch long elliptical fins inch flew stably and glided backwards on ejection. Rockets with fins of various shapes and asymmetrically mounted fins have been successfully tested.

The model rocket engines were fixed in place with tape. Tail weights on the 2.0-inch fin rocket were used to adjust the center of gravity over several flights. The center of gravity after the pitch maneuver must be at most 60% of the distance from BCP to CLA for reliable backward glide recovery. Certain models with large fins and the resultant center of gravity forward of 60% of the distance between BCP and CLA developed high spin rates during the boost phase of the flight, presumably due to accidental canting of the fins during construction. At ejection, these models transitioned to a backward glide until the spinning stopped, whereupon the rockets become forward stable and nose-dived. Rockets that are able to glide with no spin or low spin are the subjects of this invention.

The best mode of rockets for backslider recovery have a center of gravity at the time of pitch maneuver less than 60% of the distance from BCP to CLA and a center of gravity at launch forward of the BCP. For a rocket to be stable at launch, the center of gravity should be forward of the BCP by a distance of at least one times the diameter of the rocket.

what is claimed is:

1. A rocket comprising, fixed aerodynamic surfaces, a large length to diameter ratio, a fixed center of gravity between the Barrowman center of pressure and the center of lateral area wherein the center of gravity is less than 60% of the distance from the Barrowman center of pressure to the center of lateral area after the pitch maneuver, and a side thrusting means fixed on the rocket at a distance from the center of gravity sufficient to pitch the stable flying rocket in a manner to disrupt the aerodynamic stability of the rocket.

2. The invention of claim 1 wherein the length to diameter ratio is at least 30 to 1.

3. The invention of claim 1 wherein the length to diameter ratio is at least 50 to 1.

4. The invention of claim 1 wherein the center of gravity is fixed or moves forward due to the effects of fuel consumption.

5. A model rocket or large model rocket comprising fixed aerodynamic surfaces, a large length to diameter ratio, fixed rearward mounted model rocket engine, and a side thrusting means fixed on the rocket at a distance from the center of gravity sufficient to pitch the stable flying rocket substantially perpendicular to the direction of flight wherein the center of gravity is less than 60% of the distance from the Barrowman center of pressure to the center of lateral area at engine ejection.

6. The invention of claim 5 wherein the length to diameter ratio is at least 30 to 1.

7. The invention of claim 5 wherein the length to diameter ratio is at least 50 to 1.

8. The invention of claim 5 wherein the center of gravity is between the Barrowman center of pressure and the center of lateral area after the pitch maneuver.

9. The invention of claim 5 wherein the center of gravity moves forward due to the effects of fuel consumption.

10. The invention of claim 5 wherein the side thrusting means is an ejection port.

11. The invention of claim 10 wherein the ejection charge from the model rocket engine is vented through the ejection port.

12. The invention of claim 10 wherein the ejection port is located in the body tube just below the nose cone.

13. The invention of claim 10 wherein the ejection charge from the model rocket engine is vented through the ejection port.

14. A model rocket comprising fixed aerodynamic surfaces, a body tube with a length to diameter ratio of at least 30 to 1, a fixed center of gravity after engine ejection less than 60% of the distance between the Barrowman center of pressure and the center of lateral area after the pitch maneuver, a fixed rearward mounted engine, and an ejection charge vent hole just below the nose cone.

* * * * *